United States Patent [19]

Ramm et al.

[11] Patent Number: 4,645,624

[45] Date of Patent: Feb. 24, 1987

[54] CONTAINMENT AND DENSIFICATION OF PARTICULATE MATERIAL

[75] Inventors: Eric J. Ramm, Lilli Pilli; Alfred E. Ringwood, Redhill, both of Australia

[73] Assignees: Australian Atomic Energy Commission, Lucas Heights; The Australian National University, Acton, both of Australia

[21] Appl. No.: 524,841

[22] Filed: Aug. 19, 1983

Related U.S. Application Data

[63] Continuation-in-part of Ser. No. 282,327, Jul. 10, 1981, abandoned.

[30] Foreign Application Priority Data

Aug. 30, 1982 [AU] Australia ..... PF5670

[51] Int. Cl.[4] ..... G21F 9/16; G21F 9/12

[52] U.S. Cl. ..... 252/628; 250/506.1; 252/633; 264/0.5; 264/332; 419/48; 419/51

[58] Field of Search ..... 252/628, 629, 633, 626, 252/627, 631, 635; 264/0.5, 332, 319; 250/506.1, 507.1; 419/48, 51

[56] References Cited

U.S. PATENT DOCUMENTS

| | | | |
|---|---|---|---|
| 2,885,287 | 5/1959 | Larson | 264/0.5 |
| 3,000,072 | 9/1961 | Evans | 252/629 |
| 3,160,502 | 12/1964 | Quartullo | 419/48 |
| 3,213,031 | 10/1965 | Heinemann et al. | 252/633 |
| 3,340,056 | 9/1967 | Cloran et al. | 75/214 |
| 3,383,208 | 5/1968 | Corral | 75/214 |
| 3,935,467 | 1/1976 | Gablin | 252/633 |
| 4,058,479 | 11/1977 | White et al. | 252/633 |
| 4,115,311 | 9/1978 | Sump | 252/628 |
| 4,172,807 | 10/1979 | Larker | 252/629 |
| 4,192,629 | 3/1980 | Hallenius et al. | 252/629 |
| 4,209,420 | 6/1980 | Larker | 252/626 |
| 4,280,921 | 7/1981 | May | 252/628 |
| 4,409,029 | 10/1983 | Larker et al. | 419/10 |

FOREIGN PATENT DOCUMENTS

| | | | |
|---|---|---|---|
| 0044381 | 1/1982 | European Pat. Off. | 252/628 |
| 0044692 | 1/1982 | European Pat. Off. | 252/629 |
| 2600790 | 7/1977 | Fed. Rep. of Germany | 252/633 |
| 2659691 | 11/1978 | Fed. Rep. of Germany | 252/628 |
| 2369659 | 5/1978 | France | 252/628 |
| 0073300 | 6/1977 | Japan | 252/628 |
| 0116600 | 9/1979 | Japan | 252/628 |

OTHER PUBLICATIONS

Hoenig et al., 1983, Densification Studies of Synroc D for High-Level Defense Waste, Lawrence Livermore National Laboratory, 55 pages.

Ringwood, A. et al. 1979, The Synroc Process: A Geochemical Approach to Nuclear Waste Immobilization, Geochemical Journal 13:141-165.

*Primary Examiner*—Stephen J. Lechert, Jr.
*Assistant Examiner*—Howard J. Locker
*Attorney, Agent, or Firm*—Ladas & Parry

[57] ABSTRACT

Particulate material is poured into a container which is decay and heat resistant, the container is sealed and subjected to axial compression at elevated temperature to cause densification of the material, there being an arrangement for preventing substantial radially outward deformation of the container during compression. An important application is to immobilization of nuclear reactor waste in a synthetic rock structure formed during the high temperature compression step, and advantageously the containers are secured within an outer metal cannister for subsequent safe handling and disposal. An important embodiment includes a bellows container which advantageously is upwardly pressed into an inverted metal cannister restrained by an upper abutment, the bellows container becoming an interference fit within the metal cannister during the final portion of compression, but the bellows container wall itself being substantially sufficient to prevent gross outward deformation of the bellows container.

26 Claims, 12 Drawing Figures

CONTAINMENT AND DENSIFICATION OF PARTICULATE MATERIAL

RELATED APPLICATION

The present application is a continuation-in-part of application Ser. No. 282,327 dated July 10, 1981 (now abandoned).

FIELD OF THE INVENTION

The present invention relates to the containment and densification of particulate material in suitable containers and is specially applicable to arrangements for containing waste material for long term storage. One important and especially valuable application of the invention is to immobilisation of high level radioactive waste material such as that produced by nuclear reactors. However, other analogous applications are within the broad scope of the present invention, for example densification and containment of the shredded spent nuclear fuel rod tubes.

BACKGROUND OF THE INVENTION

Extremely long term safe storage of nuclear wastes is a major problem for the nuclear industry and various proposals have been made for dealing with this problem. One proposal concerns immobilising the waste in a suitable borosilicate glass which can then be deposited in a suitable geological formation. However, doubts concerning possible devitrification of the glass and consequent leaching of radioactive elements have founded criticism of the safety of this technique.

Another recent proposal involves the formation of a synthetic rock in which the nuclear reactor waste is immobilised, details of this method being described by A. E. Ringwood et al in NATURE March 1979. According to the disclosed, a selected synthetic rock is formed with the radioactive elements in solid solution. The constituent minerals of the rock or close structural analogues have survived in a wide range of geochemical environments for millions of years and are considered highly resistant to leaching by water.

The nuclear reactor waste is incorporated into the crystal lattices of the synthetic rock in the form of a dilute solid solution and therefore should be safely immobilised. A dense, compact, mechanically strong block of the synthetic rock incorporating the nuclear waste is produced by pressure and heat in a densification process and the block may then be safely disposed of a suitable geological formation.

The following patent applications have been filed by the Australian National University based on the work by A. E. Ringwood et al:

U.S. patent application No. 54957 entitled "Safe Immobilisation of High Level Nuclear Reactor Wastes"; and U.S. patent application No. 124953 entitled "A Process for the Treatment of High Level Nuclear Wastes".

The present application, in some embodiments, is concerned with making use of the synthetic rock arrangements of A. E. Ringwood et al and is concerned with an apparatus and method for producing disposable blocks of materials which can include radioactive wastes in an immobilised form. However, the present application is not necessarily restricted to the particular classes of synthetic rocks of A. E. Ringwood et al and the apparatus and method described herein could be applied to other synthetic rocks in addition to those specifically described by A. E. Ringwood et al.

Other examples of synthetic rock systems which might be used with aspects of the present invention could include the following:

1. Supercalcine (G. J. McCarthy, Nuclear Technology, Vol. 32, January 1977)
2. Product of Zeolite Solidification Process (IAEA Technical Report Series No. 176, pages 51).
3. Product of Titanate Solification Process (IAEA Technical Report Series No. 176, pages 53).
4. Product of the Sandia Process (R. W. Lynch and R. G. Dosch, US Report SAND-75-0255 (1975).

For the purposes of this specification, synthetic rock is defined as a material which consists chemically of one or more metal oxides (or compounds derived from metal oxides which have been formed into a rock-like structure) by subjecting a mass of solid particles of the material to heat and pressure.

SUMMARY OF THE INVENTION

For the purposes of exemplification, the invention will be described with reference to the problem of treating nuclear reactor wastes and in particular the invention will be described with reference to the problem of immobilising such wastes in a synthetic rock structure; however, the invention is not to be limited to use of such a supply material.

In this application, the invention concerns apparatus and method for immobilising waste material in synthetic rock with a high degree of safety, and in this application it is necessary for the process to be conducted by remote control in a "hot cell". The method comprises:

(a) establishing a quantity of supply material in a cylindrical container, means being provided by preventing gross outward deformation of the cylindrical container during the method, the cylindrical container being sufficiently heat and corrosion resistant to contain the supply material during and after the method has been effected and the supply material comprising material for forming the synthetic rock and a minor proportion of nucler reactor waste capable of being immobilised in the synthetic rock when densified into a block;

(b) applying pressure to compress the supply material along an axis of the container and applying heat to cause densification and the formation of a block of synthetic rock including the nuclear reactor waste; and (c) either before or after said densification step, sealing the container with a metal cap whereby the sealed container is adapted to be removed and placed in a suitable long term storage location.

In one embodiment, the cylindrical container is mounted in a cavity in a refractory support element which prevents gross outward deformation. In another embodiment, the cylindrical container is formed so as to collapse in a bellows-like manner under axially pressure, the wall structure of the container itself preventing gross outward deformation.

At least preferred embodiments of the invention provide a simple and effective method which can readily be practiced in a "hot cell" and a relatively safe and easily handled product ensues. It is considered that during very long term storage radiation damage within the synthetic rock is likely to cause a small expansion perhaps of the order of 2% to 3%. At least in preferred embodiments, such long term expansion can be accommodated without increased risk of contamination of the environment, for example through leaching with ground water.

Another important factor from an economics point of view is that the process is relatively simple and therefore can be readily conducted in a hot cell. Apparatus having a long working life is required as inevitably contamination of the apparatus will occur in the method and decontamination and disposal of worn apparatus is therefore an expensive and inconvenient operation.

Further advantages can be achieved with various embodiments of the invention including preferred or optional features discussed below.

Preferably, the cylindrical container has a sealed bottom end wall and only the final step of welding or otherwise permanently fixing a metal cap to the top of the container is required in the hot cell.

At least for the formation of some types of synthetic rock it is considered that the present method is best implemented by including in the supply material or in contact therewith a suitable metal in a suitable quantity to provide a selected oxygen potential to facilitate the effective formation of the synthetic rock with radioactive waste immobilised therein. Suitable metals to consider for providing the desired oxygen potential are nickel, titanium and iron. The metal could be provided in the form of a lining to the cylindrical container or as an inner can for the supply material or alternatively the metal could be provided in fine particulate form mixed with the supply material.

Most advantageously the present invention includes the additional step of initially forming the supply material into a granulated form which can be easily poured. This should minimise spillage and contamination in the hot cell. The ganules can be formed in a cold pressing operation, by disc granulation, by a spray drying/calcination or by fluidised bed/calcination process. Preferably, a rotary kiln is used for forming the granules.

In one embodiment of this invention, the supply material is initially charged into thin walled metal cans which will remain solid at the sintering temperatures used which are typically of the order of 1200° C. The metal can may have a close fitting lid and the supply material could be poured or cold pressed into the can before the lid is fitted. Preferably the lid is tight fitting so as largely to retain any components of the nuclear waste which are somewhat volatile at the high sintering temperatures. This step can be very important to the economics of operation since contamination of the hot cell by such volatile components can be largely minimised.

The thin walled metal can could have a close fitting lid rather like a paint tin and can be made of nickel or iron and indeed the choice of such metals can provide the preferred oxygen potential.

One useful material for the cylindrical container is stainless steel which is sufficiently corrosion resistant and has sufficient high temperature strength to be readily used in the present method. One such steel is that known as Sandvik 253MA.

Typically heating to about 1260° C. and the application of pressure of about 7 MPA will be suitable sintering conditions. The pressure could be increased, for example, up to 14 MPA. However, in order to cause effective sintering and densification of the supply material, a practical limit exists as to the maximum height of a column of supply material. Therefore in one useful embodiment of the invention, the method includes using an apparatus in which the refractory support element includes a series of separate electrical induction heating coils disposed to apply heat selectively to regions extending respective distances along the axis of the cylindrical container, whereby a series of densification steps occur commencing at one end of the container, the induction coils being utilised in sequence after the densification and sintering of the previous section of the supply material.

Most conveniently, water cooled induction coils in partially overlapping relationship are provided. During the method a constant pressure is applied to the supply material by means of a refractory faced plunger or ram inserted into the open end of the container and gradual densification occurs. At least prior to the final step of sintering, it is most economic to top up the container to compensate for the densification which has occurred up to that stage. an additional quantity of supply material or an additional small can of supply material may be inserted before the final step. A close fitting refractory spacer is then inserted on top of the supply material to prevent the refractory faced plunger from entering the final heat zone.

The pressure, most conveniently, is applied from a lower supporting hydraulic ram and from a refractory faced metal ram in contact with the supply material. The refractory facing protects the metal ram from overheating. Water cooling of the metal ram may also be desirable.

The invention may be implemented in a manner which carefully minimises outward deformation of the cylindrical container and yet provides a long working life for the apparatus. In one advantageous embodiment, a refractory support element having a slightly tapered bore in which the container is a clearance fit is used together with refractory grains which are poured into and compacted in the space between the cylindrical container and the tapered bore so as to provide a relatively dense buffer to restrain substantially outward deformation of the cylindrical container during the densification step. The ejection step can simply comprise operating a bottom ram to press upwardly the container which can slide relative to the grains and the grains can then fall from the bore in the support element to be collected and recycled.

The method can include vibrating the refractory grains in order to provide a good density and resistance to deformation of the cylindrical container.

According to a second aspect of the invention, there is provided an apparatus for use in the method as described in any one of the embodiments above in accordance with a first aspect of the invention; the apparatus comprises a refractory support element with a bore in which the cylindrical container containing the supply material is adapted to be placed with a clearance between the walls of the container and the walls of the cavity, means being provided for introducing granular refractory material into the space between the cylindrical container and the wall of the cavity, means for compacting the granular material in the cavity whereby outward deformation of the cylindrical container under heat and pressure is substantially restrained, means for applying heat in the sintering process to the supply material within the cylindrical container, means for applying densifying pressure in the axial direction of the container, means being provided for removing the container after the densification step and means being provided for collecting and reusing the granular material after removal of the container.

Most preferably the apparatus includes induction heating coils which are water cooled.

In a commercially advantageous embodiment, the apparatus is adapted to handle a relatively long container which might be up to approximately 3.6 meters long and up to approximately 375 mm in diameter; the apparatus in this embodiment should include a series of separate induction coils to permit densification and sintering of the supply material zone by zone from one end of the cylindrical container in separate steps thereby ensuring effective densification and sintering along the entire mass of supply material in the cylindrical container.

Preferably the zones overlap to ensure a continuous mass of properly densified material in the container at the end of the process.

According to a third aspect of the invention there is provided a disposable element comprising a sealed cylindrical container containing a densified synthetic rock mass including, in the crystal structure, a minor proportion of nuclear reactor waste, the element being produced by the method of the first aspect of the invention or the apparatus of the second aspect of the invention.

An important embodiment of the invention is one in which the supply material is poured into a bellows container of generally cylindrical form with a side wall including a bellows-like formation and of heat and decay resistant material, the bellows container after being filled and sealed with a lid being displaced upwardly against an abutment and the axial pressure being maintained at sufficiently elevated temperature to cause densification of the particulate supply material and axial compression of the bellows container. This very important embodiment is a simple but surprisingly effective selection since it can be safely, reliably and effectively implemented in a hot cell, bearing in mind that at elevated temperature the bellows container itself will have greater reduced strength and ductility and spillage of the supply material in the event that the bellows container split would be a serious problem. An extremely high degree of reliability and safety is required. This embodiment especially can provide a most effective and reliable process for use with supply material in the form of high level radioactive waste and capable of long term operation in a hot cell with ease of operation of the process and maintenance of equipment.

Furthermore, the method characterised by the upward pressing technique permits considerable economy of capital equipment and the hot cell space required by virtue of the use of a single ram with a fixed abuttment. Since typically operating temperatures in the region of 1100° C. will be used, a substantial refractory facing can readily be provided for the fixed abutment and also for the refractory ram. The upward pressing method facilitates, in a preferred embodiment, a most easily serviced apparatus since the refractory facing for the ram can simply be a disc-like pad located by simple locating means such as a spiggot and socket with the pad essentially remaining in position under the force of gravity. Thus, using manipulators in a hot cell a worn refractory pad can readily be removed for disposal and a replacement pad fitted.

Furthermore, a major improvement in the process can occur when the broad method described above is used in combination with a preheating step substantially without the application of pressure.

The high working temperatures for the densification step are best achieved by the use of induction heating and therefore typically it takes many hours for the contents of the bellows container to come to a uniform working temperature. Therefore preheating of the bellows container to bring the contents up to a uniform temperature suitable for the densification step is a major advantage. Not only can the production rate for given capital cost be maximized but furthermore a substantial further advantage is that bringing the contents of the bellows container to the uniform densification temperature aids reliable and uniform densification thereby ensuring reliable axial compression of the bellows container which facilitates its later handling and storage. It is to be noted that the bellows container is typically of a heat resistant steel and preferably a stainless steel. Inevitably the mechanical strength of the steel is reduced at the high densification temperatures in the region of 1100° to 1200° C.

Furthermore, the broad method may be utilized in a surprisingly effective and synergistic combination of steps in which the bellows container is subjected to the densification step whilst in a cylindrical cannister in which the bellows container becomes a tight fit after the pressing operation thereby providing a most effective and convenient extra containment for long term safe storage of the waste material. Such a method may be defined as consisting in a method for the containment of particulate waste material, the method comprising pouring the waste material into bellows containers of generally cylindrical form with a side wall including a bellows-like formation and of heat and decay resistant material, closing each bellows container with a lid, preheating in series the bellows containers to being the contents thereof to a substantially uniform elevated temperature, placing each bellows container in turn on an upwardly displacable ram and displacing the ram upwardly to insert the bellows container into a cylindrical container and applying pressure and maintaining a sufficiently elevated temperature for sufficient time to cause densification of the contents of the bellows container with axial compression of the bellows container and relatively slight outward expansion thereof to cause the bellows container to grip the interior wall of the cylindrical container, and when the container has been filled with a series of such bellows containers, sealing the container and removing the container for storage.

Whilst the invention is particularly useful in relation to the incorporation of high level radioactive waste in synthetic rock of the type described by A. E. Ringwood (and referred to above), the invention can also be applied to other synthetic rock arrangements and furthermore can also be applicable to other materials which require storage and are capable of compaction under heat and pressure. One exammple of such other material would be shredded waste zirconium alloy nuclear fuel rod tubes and similar waste components.

It will be appreciated that the invention consists in a combination of steps which cooperate together in an advantageous relationship which permits efficient, economic, and convenient operations in a hot cell. The apparatus used can be relatively simple, and this can contribute greatly to the reliability and acceptability of the system due to simplicity of servicing the intrinsic reliability.

In a commercial scale operation, it is envisaged that the cylindrical container will be of the order of 30 cm diameter and 2 meters long and each bellows container will be compressible from an initial height of about 40 cm to a final height of about 10 cm. The use of induction heating coils is the preferred method of both preheating and maintaining the necessary elevated temperature during the densification step, and due to the fact that heating of the particulate material is due to conduction from the bellows container (which is heated by the induction heating coils) a considerable time is required for the preheating step. In a preferred embodiment of the invention, preheating for several hours can be effective whereas the final densification step will be much shorter, e.g. about one hour.

Most preferably, the bellows container is given a preliminary axial pressing which can be at ambient temperature or with advantage can be at a bellows container temperature of up to about 800° C. to anneal the material of the bellows container. Since the bellows container will have a high degree of strength at ambient temperature and also at temperatures up to about 800° C., good control can be achieved in this preliminary axial pressing and, surprisingly, during the densification step at high temperature (typically 1200° C.) excellent control of the axial pressing can be achieved thereby essentially minimizing the risk of the bellows container compressing with sideways shear rather than true axial compression.

Preferably, the pressure in the preliminary pressing is of at least 3000 lbs/sq. inch.

Particularly when synthetic rock is to be formed, the material is preferably provided in the form of well graded fine particles up to about 2 mm maximum dimension whereby a readily pourable material is provided which can be easily densified in the process.

Preferably synthetic rock is used to incorporate radioactive waste, a mixture of synthetic rock precursor and high level waste being sprayed into a rotary kiln to produce the intimately mixed materials. In order to reduce what would otherwise be loss from the solid material of potentially volatile radioactive components, the temperature at the region in which the material is introduced into the rotary kiln is preferably controlled in the range of about 400°-600° C., and the maximum temperature in the kiln is about 700°-800° C. with the exit from the rotary kiln being at ambient temperature.

A preferred embodiment of the invention can also provide further means for safeguarding the cylindrical container from outward deformation under the pressure of expanding bellows containers within the container. This is achievable by the use of a block of refractory material having a slightly tapered bore which at its narrowest diameter just fits over the container, the refractory block being adapted to be moved downwardly in a series of steps corresponding to bellows container locations, the slightly tapered bore permitting release of the block even if some outward deformation of the container has taken place in a step of densification and compression of the bellows container.

Most preferably, the refractory block is formed so as to embrace the induction heating coil for surrounding the container.

Most preferably, the refractory block comprises a series of interocking refractory segments arranged to be mounted inside a cylindrical containment shroud which absorbs any expansion forces applied from the container.

According to a further aspect of the invention, there is provided apparatus for encapsulating particulate supply material in bellows containers within a cylindrical container, the apparatus comprising means for pouring the particulate material into a bellows container, means for sealing the bellows container with a lid, means for moving bellows containers in sequence to a pressing station, a pressing station comprising an upwardly displaceable ram for receiving a bellows container, means for mounting a cylindrical cannister with an open end directed downwardly towards said ram, means for actuating said ram to press upwardly into the cannister a bellows container supported on the ram, upper refractory support means to act as an abutment on the top of the cannister, heating means for maintaining an elevated temperature in said bellows container whilst said pressure is applied to cause densification of said material in the bellows container and to expand slightly the bellows container to cause it to jam in the cannister, the heating means being adapted to provide heating in a series of zones within the cannister corresponding to a series of bellows containers inserted one below the other in series therein, and means for removing the cannister when a series of bellows containers have been densified and secured therein.

BRIEF DESCRIPTION OF THE DRAWINGS

For the purposes of exemplification only, embodiments of the invention will now be described with reference to the accompanying drawings, of which.

DETAILED DESCRIPTION OF THE DRAWINGS AND PREFERRED EMBODIMENTS

Figure 1:
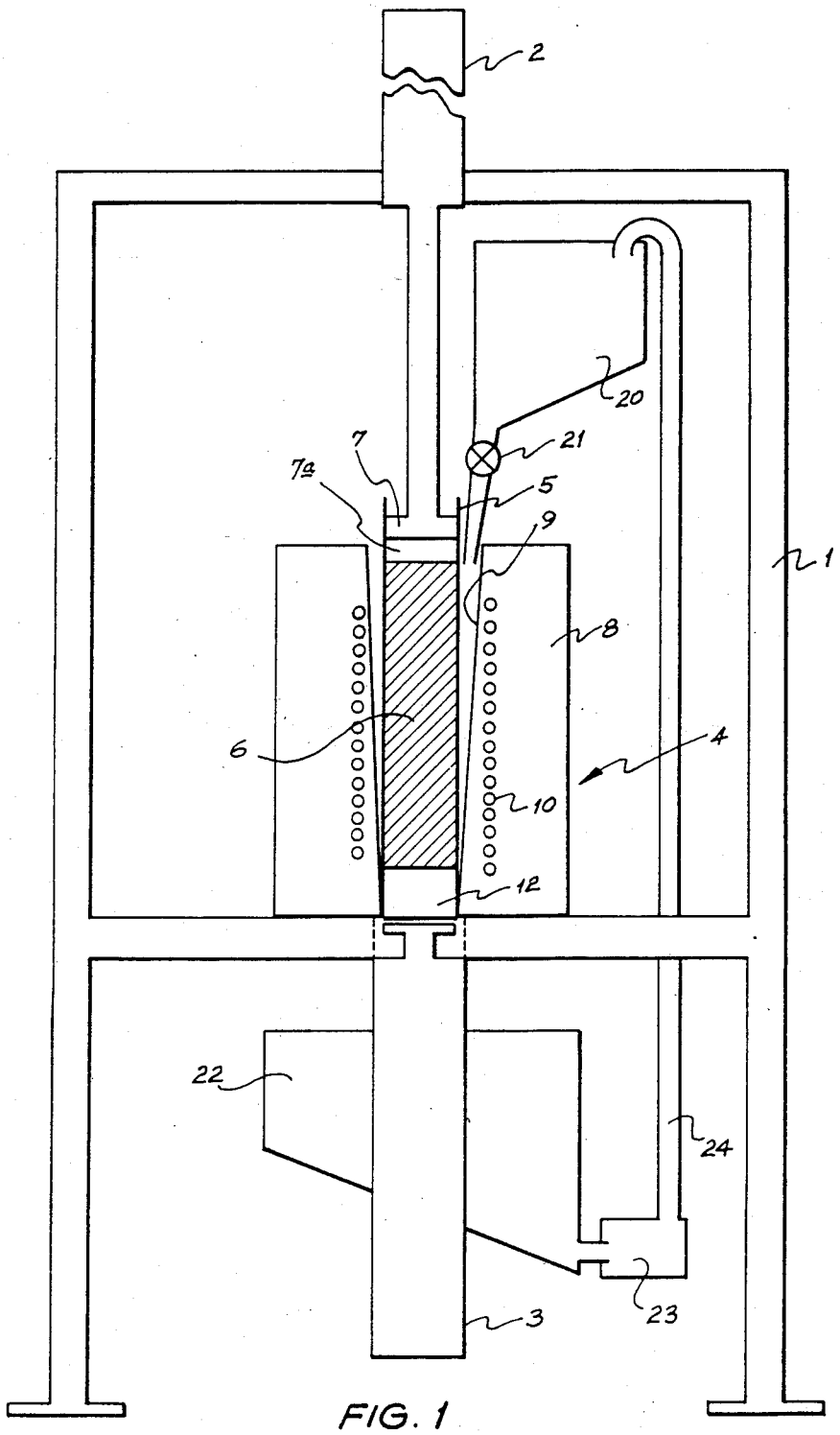
FIG. 1 is a schematic elevation of an apparatus arranged for practising an embodiment of the invention.

Referring first to FIG. 1, the apparatus comprises a steel framework 1 supporting top and bottom hydraulic rams 2 and 3 and an electrical induction furnace 4 arranged to received a metal container 5 containing supply material 6 for densification and sintering within the metal container. As shown in FIG. 1, the bottom ram 3 has a head adapted to support the bottom of the container, the head having a suitable refractory block 12 thereon and the top ram is adapted to have a plunger 7 with a refractory facing *7a* which extends within the container for applying pressure in the axial direction of the container to the powdered supply material 6.

The induction furnace 4 comprises a block 8 of refractory material having sufficient tensile strength to withstand the substantial applied pressures and to absorb the forces tending to expand radially outwardly the metal container. The refractory block 8 has a tapered central bore 9 for receiving a refractory granular in-fill for supporting the metal container. Furthermore the block 8 includes a series of internally water cooled electrical induction coils 10.

Granular refractory material is poured from a hopper 20 when valve 21 is opened to fill the tapering space between the container 5 and bore 9. When the process is finished by ejection of the container, the granular refractory material falls down into a collecting bin 22 from which it is pumped by pump 23 through line 24 back to the hopper 20.

Figure 2:
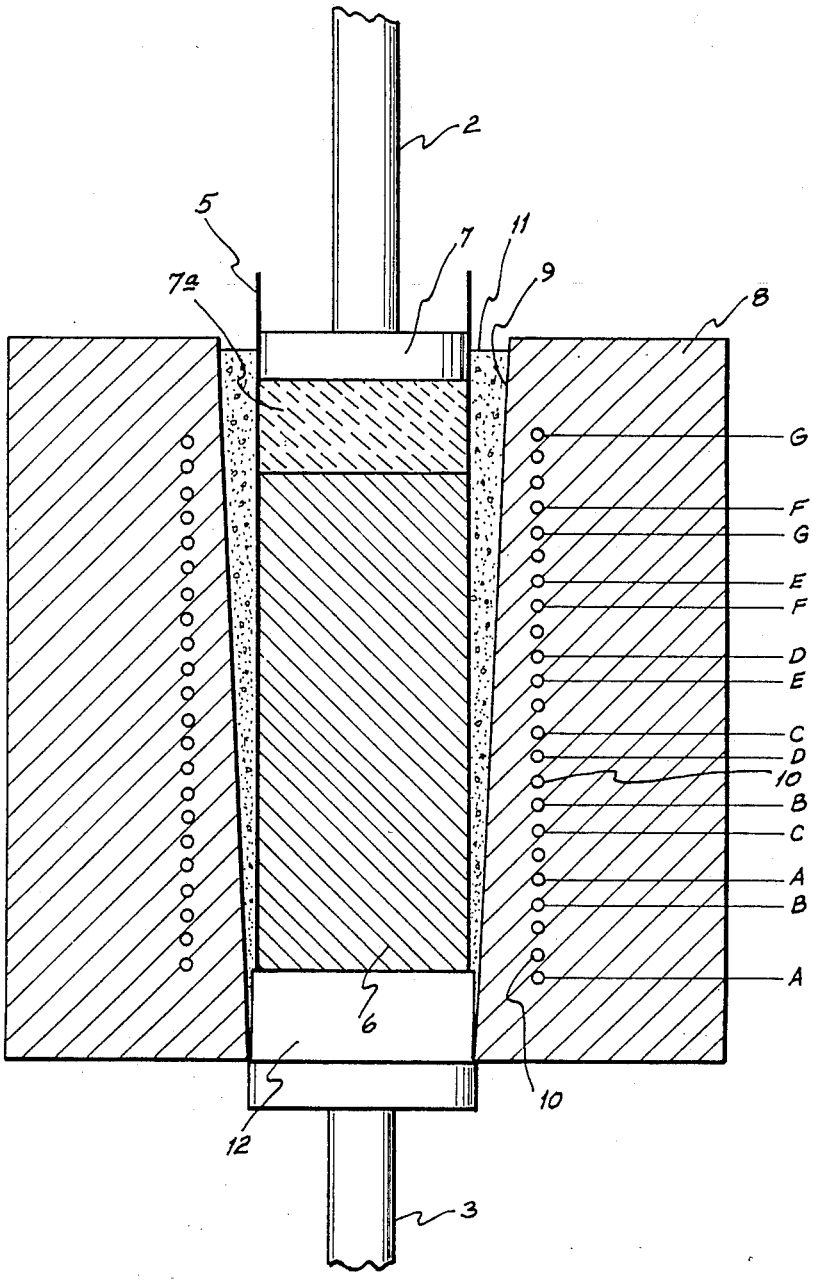
FIG. 2 is a view on an enlarged scale of the central part of the apparatus of FIG. 1 taken in axial cross sectional elevation.

Referring now to FIG. 2, it will be seen that compacted granular refractory in-fill 11 is disposed in the tapered annular space between the exterior of the circular cross section metal container 5 and the bore 9 in the block 8.

It will also be seen that the induction coil 10 comprises a series of separate induction coil tappings which overlap one another, the respective end tappings being labelled A—A, B—B etc.

FIG. 2 also shows the bottom ram 3 is capable of being moved upwardly through the cavity 9 for ejecting the final product.

A typical method of operation comprises the following steps:

(i) With the top ram 2 retracted, the metal container 5 having a closed bottom end is placed in the cavity 9 on top of the refractory block 12 which is in the position shown in the drawings.

(ii) The nuclear waste material is mixed as a minor proportion with the components for forming the synthetic rock and readily poured granules are formed. A quantity of the granulated supply material is then poured into the metal container 5 until it is substantially filled and the top ram 2 is lowered.

(iii) The refractory granular material 11 is then poured into position and compacted for example by vibrating so that the metal container is well supported against radially outward deformation.

(iv) Pressure is applied by activating the hydraulic rams 2 and 3 to compact the supply material 6 in the metal container. Typically a pressure of about 7 MPA is applied.

(v) Heating in the bottom zone only of the supply material is effected by connecting terminals A—A of the induction coil 10 to a power supply. A typical power supply operates at 3 KHz. Over a period of typically 45 minutes the temperature of the supply material in the zone A—A is brought up to a sintering temperature of about 1260° C. and power is maintained for about 3 hours whilst maintaining the pressure.

(vi) The induction coil portion A—A is then disconnected and the induction coil portion B—B connected to the power supply. It will be seen that a degree of overlapping occurs so that a continuous densified solid phase is produced in the metal container. Each induction coil segment is activated in turn for a time of about 3 hours until only a small segment of supply material exists between the zone being densified and the ram facing *7a*. The ram 2 is then withdrawn and the metal container topped up with supply material and the method continues until just prior to the step of activating the induction coil segment G—G. Prior to this the refractory facing *7a* is inserted to space and insulate the ram from the heated material.

(vii) After densification of the top portion of the supply material has been completed, pressure is maintained and the element is allowed to cool to about 300° C. Pressure is then removed and the top refractory faced ram 2 is withdrawn.

(viii) The bottom ram 3 is activated to eject the metal container 5 from the induction furnace, simultaneously permitting the refractory granular material 11 to fall down to be collected in a recycling device.

(ix) The excess top wall portion of the metal container 5 is removed and a metal cap welded to close the container. The container can then be disposed of in a suitable geological formation.

Figure 3:
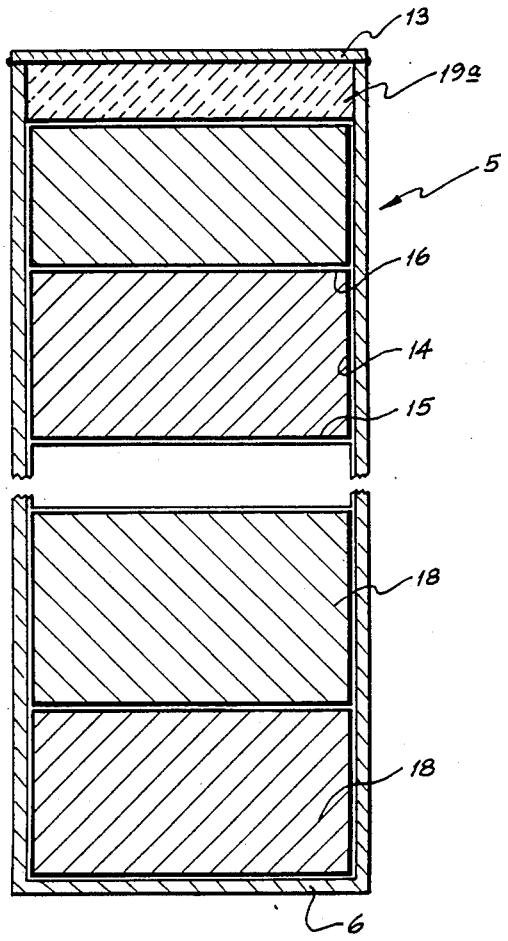
FIG. 3 is a schematic view on an enlarged scale of a processed disposable element formed by using an embodiment of the ivention.
Figure 4:
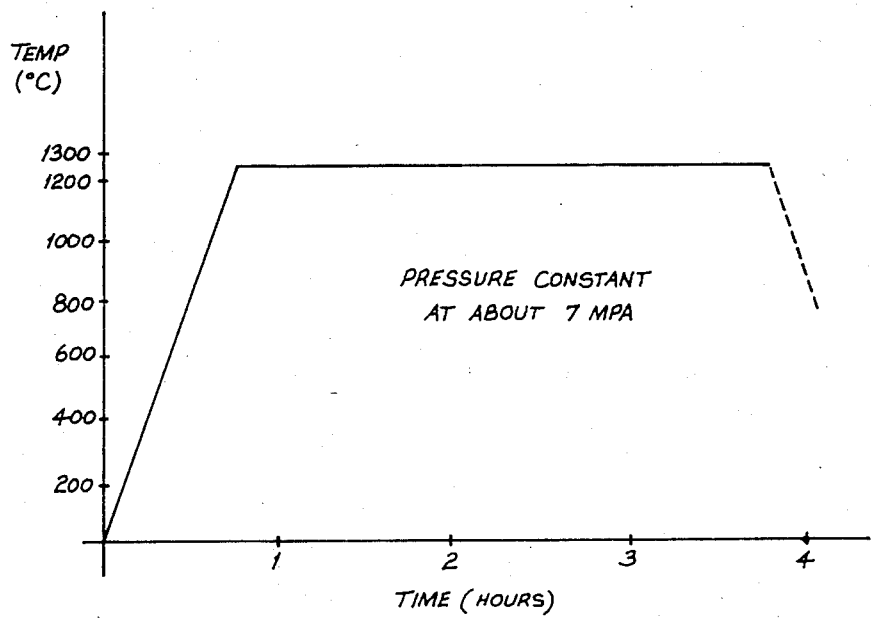
FIG. 4 is a graph illustrating a typical applied pressure and temperature cycle.

Reference will now be made to FIG. 3. FIG. 3 illustrates a preferred embodiment of container but is not to scale. In the preferred embodiment the metal container 5 is formed with an integral bottom wall 6 and is typically of a 6 to 8 millimeters wall thickness and a diameter of 100 mm or more. FIG. 3 illustrates the final unit after a cap 13 has been welded into position. Conveniently the metal is stainless steel of Sandvik grade 253 MA.

In this embodiment the supply material is introduced into the metal container in thin-walled cans 14 having an integral base 15 and a press-fit lid 16. The cans could be similar to conventional paint tins and are preferably of a metal which provides the suitable oxygen potential to facilitate the incorporation of the waste into the synthetic rock. Thus the cans could be of nickel or iron or the like.

To form the unit of FIG. 3 it is preferable initially to cold press or otherwise form the supply material into granules which are poured into the cans. Lids 16 are then press fitted. The cans are then inseted into the metal container 5 when disposed as shown in FIG. 2 prior to the densification operation. During the densification operation the cans, which conveniently correspond in height to each induction coil segment A—A, B—B etc. are compressed with the contained supply material thereby aiding in the retention of any volatile components in the supply material. Furthermore contamination of the apparatus of FIG. 2 can be minimised by using this thin can technique. It has been found that the cans do not signficantly buckle in their wall section but are compressed and come into intimate engagement with the interior of the metal container 5. FIG. 3 illustrates the final product with blocks of synthetic rock 18 within the thin walled metal cans 14. A refractory spacer 19a is left in the container to fill the space.

Figure 5:
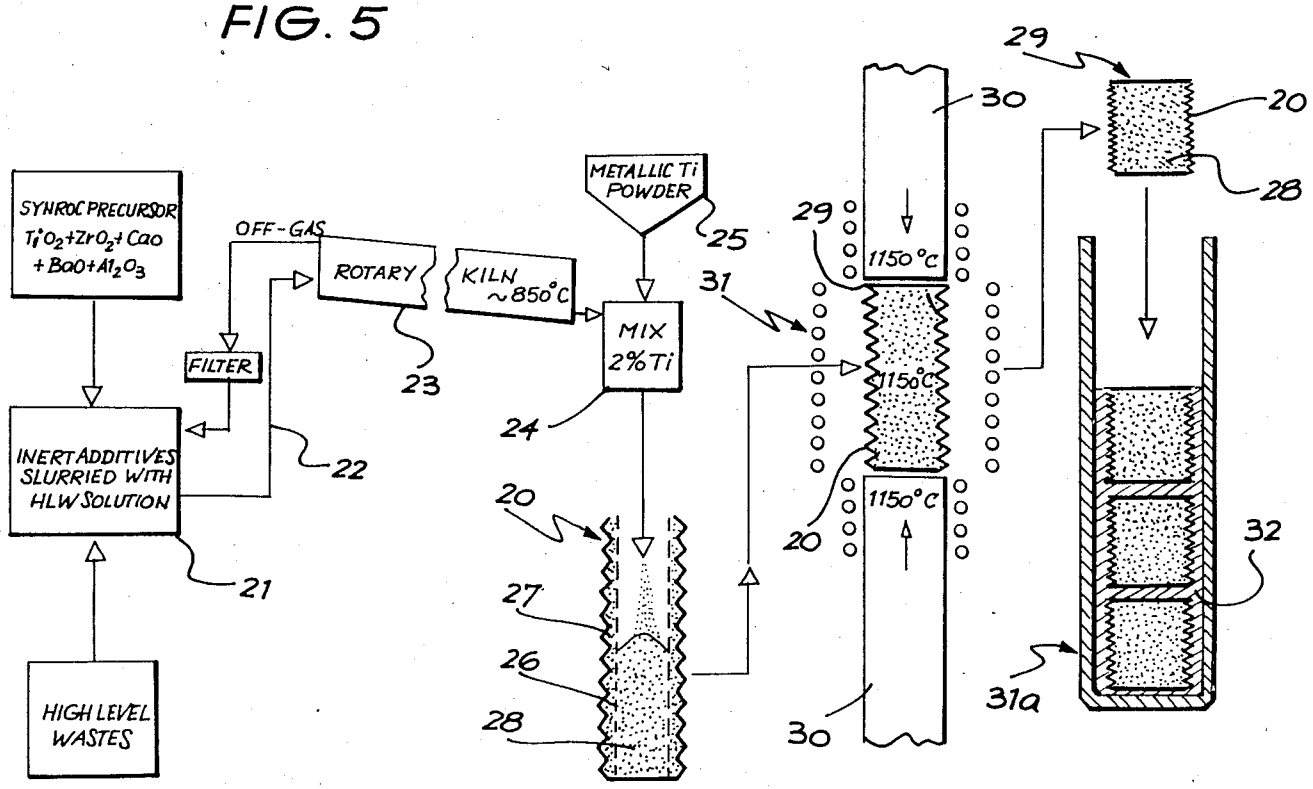
FIG. 5 is a schematic representation of a second embodiment.

The second embodiment of FIG. 5 is characterised by the use of a metal container 20 formed of stainless steel and having a bellows-like structure, the bellows-like structure preventing gross outward deformation of the container during the pressing step. FIG. 5 illustrates schematically the overall process and the apparatus which is to be used.

Outside the hot cell, non-radioactive synthetic rock precursor is produced as indicated by the step shown in FIG. 5 labelled "SYNROC precursor". The synthetic rock has a composition as indicated in the table set out below and is produced using tetraisopropyl titanate and tetrabutyl zirconate as ultimate sources of $TiO_2$ and $ZrO_2$. The components are mixed with nitrate solutions of the other components, coprecipitated by addition of sodium hydroxide and then washed.

Typical Compositions of Synthetic rock (Synroc) and Constituent Phases

| | "Hollandite" 40% | Zirconolite 35% | Perovskite 25% | Bulk SYNROC Composition |
|---|---|---|---|---|
| $TiO_2$ | 71.0 | 50.3 | 57.8 | 60.3 |
| $ZrO_2$ | 0.2 | 30.5 | 0.2 | 10.8 |
| $Al_2O_3$ | 12.9 | 2.5 | 1.2 | 6.3 |
| CaO | 0.4 | 16.8 | 40.6 | 16.2 |
| BaO | 16.0 | — | — | 6.4 |
| Total | 100.5 | 100.1 | 99.8 | 100.1 |

The precursor material is a product which possesses a very high surface area and functions as an effective ion exchange medium, which is mixed with additives containing Ca, Ba, and Al in solution and mixed in a hot cell with high level nuclear waste (HLW) in the form of nitrate solution to form a thick homogeneous slurry at mixing stage 21. Typically up to about 20% by weight of the solid content of the slurry may comprise the high level wastes.

The slurry is then fed by line 22 to a rotary kiln 23 operating at about 850° C. in which the slurry is heated, devolatilised and calcined. The resulting calcine is mixed in mixer 24 with 2% by weight of metallic titanium powder supplied from hopper 25. The mixer 24 then supplies the powder to a primary bellows container 20 of stainless steel and of bellows-like form as illustrated. It will be noted from the drawings that the bellows container can be compressed by a factor of about 3 and does not have gross outward deformation. As illustrated in the drawing, before the mixer supplies powder to the bellows container 20, a thin perforated metal liner 26 is located within the bellows container and the space between the liner and the bellows container wall is filled with zirconium oxide powder 27 or alternatively any other powder possessing low thermal conductivity properties may be used. The bellows container can then be filled with powder 28 from the mixer 24.

A stainless steel plug or cap 29 is then used to seal the bellows container and the bellows container placed between a pair of pistons 30 which are of molybdenium-based alloy and capable of operation at temperatures up to 1200° C. A radio frequency induction coil 31 is then used to raise the temperature of the ends of the pistons 30 and the bellows container and its contents to about 1150° C.

When sufficient time has elapsed for a uniform temperature to exist in the synthetic rock powder, compressive forces are then applied through the pistons 30 causing the bellows container wall to collapse axially like a bellows.

The resultant sealed compressed bellows containers containing the synthetic rock structure are then removed and stacked in a disposal cylinder 31*a* which is fabricated from highly corrosion resistant alloy such as that based on $Ni_3Fe$. The space between the primary bellows containers 20 and the internal wall of the cylinder 31*a* is filled with molten lead 32 and the cylinder finally is sealed for disposal.

Figure 6:
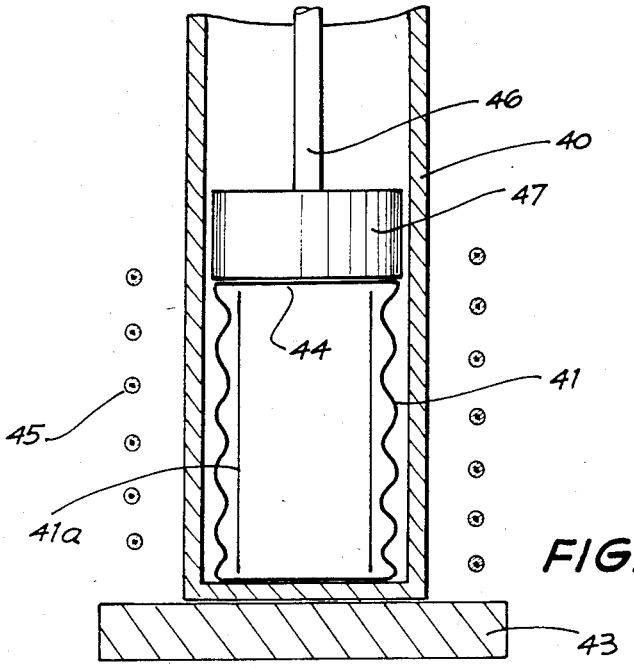
FIG. 6 is a schematic representation of a third embodiment before compression.
Figure 7:
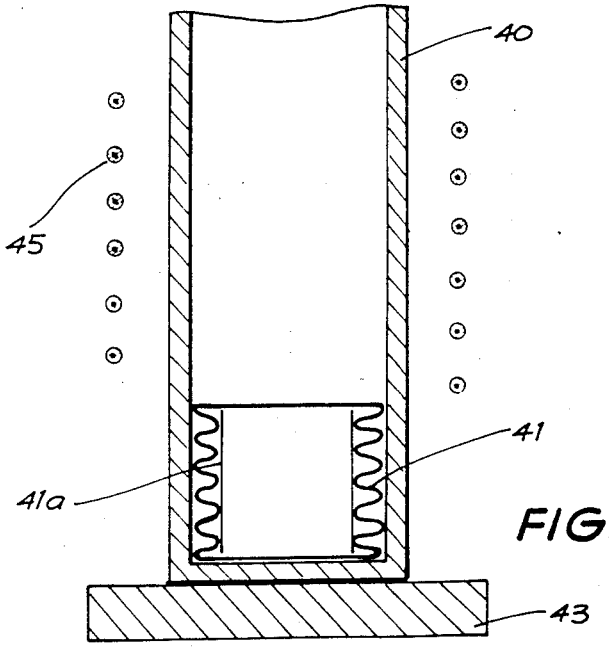
FIG. 7 is a view of the bellows container of FIG. 6 after compression.

The embodiment of FIGS. 6 and 7 is a variation on the embodiment of FIG. 5, the steps up to the mixer 24 of FIG. 5 being the same. However in this embodiment the outer cylinder or container 40 and the bellows-like container 41 are respectively dimensioned so that the clearance between the envelope of the bellows container 41 and the interior of the cylinder 40 is substantially taken up after the compression step, thus obviating the need for handling of the bellows container after compression to insert it into the cylinder and the pouring of lead to fill the cavity around the bellows container in the embodiment of FIG. 5.

As shown in FIG. 6, the cylinder 40 is supported on a base 43 and the bellows container 41 inserted with an open-ended metal cylinder 41*a* located within the bellows container. Mix from mixer 24 is then poured into the bellows container to fill the zone within the cylinder 41*a* and a top cap 44 secured in position. The whole mass is then heated by a radio frequency induction coil 45 which surrounds the outer cylinder and after sufficient time has elapsed for a uniform temperature to be reached, a ram 46 having a piston-like face 47 is used to apply compression to the bellows container 41.

As shown schematically in FIG. 7, the bellows container collapses with slight outward expansion of the bellows container but the arrangement is such that the walls of the cylinder 40 do not have any significant constraining effect on outward expansion of the bellows-like container 41. During this collapsing, in practice the cylinder 41*a* crinkles somewhat but prevents substantial ingress of synthetic rock material into the zone of the bellows, thereby obviating the risk of insufficient compression in the bellows zone and improperly formed synthetic rock occuring between the bellows corrugations. In practice the adjacent corrugations of the bellows will come together in the compression step.

FIG. 7 also illustrates how the induction coil 45 can be moved upwardly to the next location ready for treating the next bellows container which is to be inserted on top of the bellows container 41.

Figure 8:
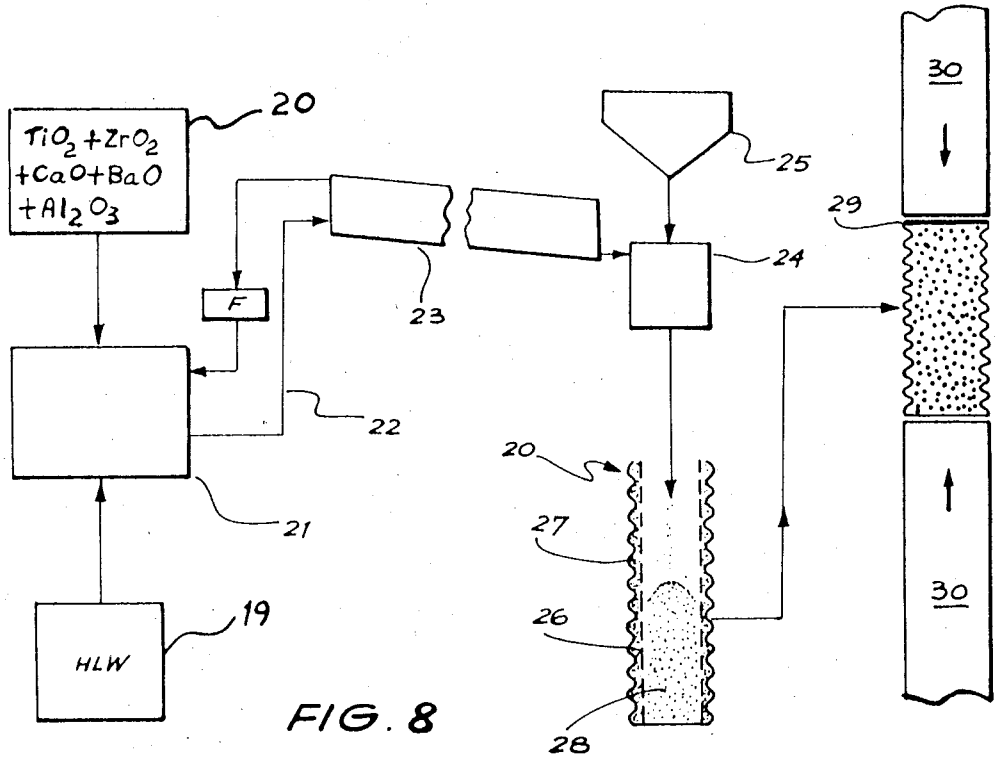
FIG. 8 is a representation of the preliminary portion of a process embodying the invention.

An alternative embodiment will now be described with reference to FIGS. 8 and 9 wherein the process illustrated has a preliminary mixing stage 21 in which synthetic rock precursor from supply 20 is formed into a slurry with high level radioactive waste from waste supply 19 which is in the form of a nitrate solution, and the slurry is passed along line 22 to be sprayed into the elevated temperature end of a rotary kiln, at which a maximum temperature in the range 700°-800° is maintained. The spraying step immediately vaporises the water content of the slurry sprayed into the rotary kiln and causes chemical decomposition of the radioactive nitrates and will cause the mineral components of the synthetic rock to start to form with the radioactive elements starting to go into mineral phases. A chemical reducing control gas (such as argon-hydrogen, nitrogen-hydrogen, or $CO—CO_2$) is passed through the rotary kiln. The process could be operated so that synthetic rock particles incorporating the radioactive waste are completely formed in the rotary kiln but this is not essential. The rotary kiln produces cold particulate material of well graded particle size up to about 2 mm maximum dimension, whereas gases produced by the rotary kiln are fed back through a filter F to the preliminary mixing stage 21 since these gases will include some radioactive components.

In order to provide the necessary oxygen potential for the radioactive waste so that it is in the appropriate valency state to be incorporated into the synthetic rock, the particulate material produced by the rotary kiln is fed into a titanium mixing stage 24 which receives metallic titanium powder from a hopper 25 whereby the mixture poured into a bellows container 20 has about 2% titanium metal powder by weight.

The bellows container 20 is of a heat resisting steel such as an austenitic stainless steel, for example Sandvik grade 253 MA which retains reasonable mechanical strength even at the elevated temperatures used in the process, although at these temperatures the container is relatively ductile. In the illustrated embodiment, a thin perforated metal liner 26 is located within the bellows container and the space between the liner and bellows wall is filled with zirconium oxide powder 27.

A stainless steel cap 29 is used to seal the bellows container which is then placed between a pair of pistons 30 for a cold pressing operation which can increase the density of particulate material from about 25% of the theoretical maximum density to about 36%.

Figure 9:
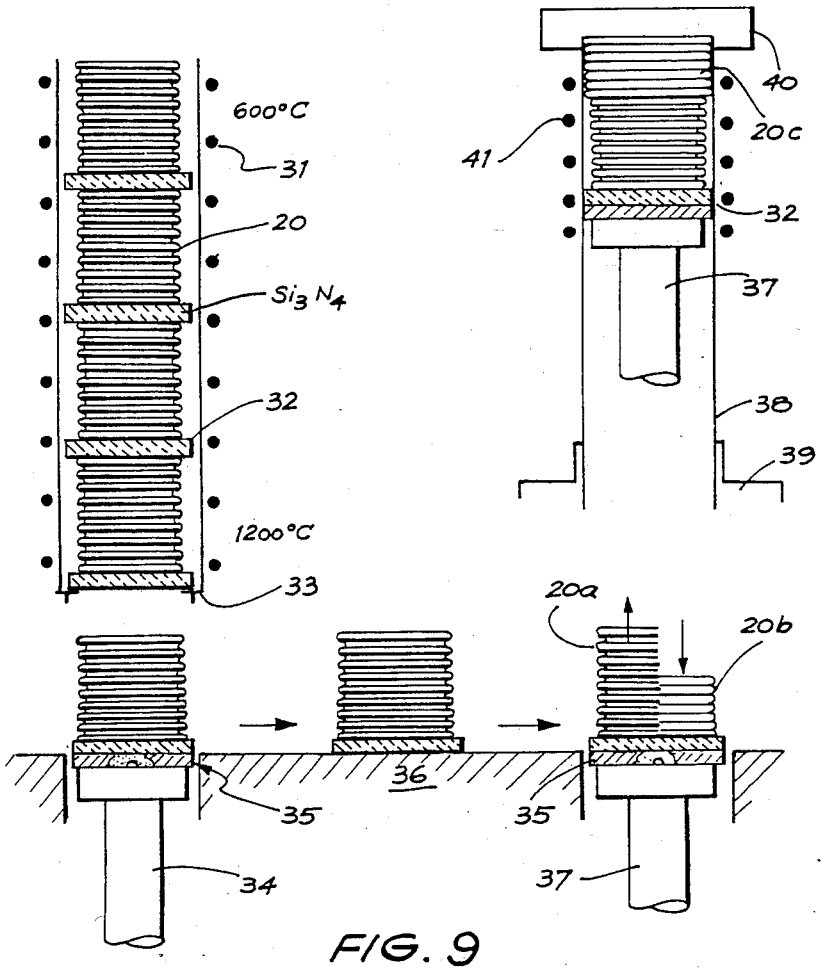
FIG. 9 is a schematic representation of the final steps of the process initiated in FIG. 8.

The next stage is illustrated in FIG. 9 in which the cold pressed bellows containers 20 are fed in sequence into a vertical induction furnace 31, each bellows container being supported on a refractory disk 32, the lowermost refractory disk being supported by a retractable latch 33. Over a period of several hours the temperature gradually increases up to about 1200° C.

A first water cooled ram 34 gaving a top spiggot on which a refractory plate 35 is located is adapted to support and lower one at a time the bellows containers from the furnace for horizontal movement across a support table 36 to a pressing station having a second water cooled ram 37 of similar form. FIG. 9 shows the ram 37 both in the lower receiving position and also in the upwardly displaced pressing position inside a metal container 38 mounted on a support 39 and having its top sealed and in abutment against a fixed refractory block 40, vertically displaceable induction heating coils 41 being provided outside the container 38.

In the lower position, the left hand side of the section of a bellows container **20*a*** is shown in its configuration *before* hot pressing and the right hand side of the section shows a bellows container **20*b*** as it would be *after* pressing. However, during the hot pressing, the bellows container slightly expands to become an interference fit within the container 38 as shown by bellows **20*c* at the top of the container 38**.

The refractory plate 32 upon which each of the bellows containers is supported is removed after the pressing stage, the plate 32 being lowered on the water cooled ram 37 and then pushed onto a receiving table from which the plate can be recylced for further use.

Refractory plates will wear in use and must be replaced and an important advantage of the design illustrated in FIG. 9 is a very simple and easily serviced arrangement made possible by the use of an upward pressing technique; this permits the replaceable refractory top plate 35 simply to sit on the head of each water cooled ram. Just a simple spiggot and socket arrangement is provided so that manipulators can readily remove a worn refractory plate and insert a new one.

Figure 10:
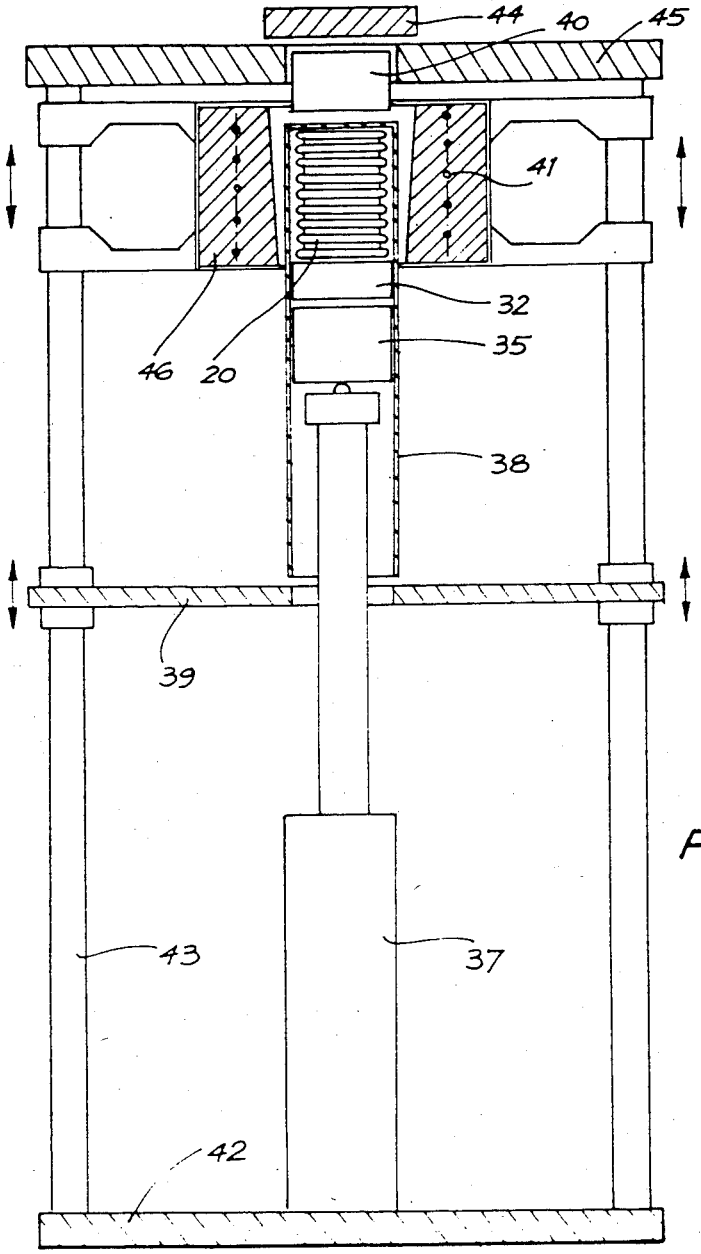
FIG. 10 is an axial sectional elevation illustrating a preferred embodiment of apparatus for effecting the densification step of the waste material.

Referring now to FIG. 10, a practical embodiment of hot pressing apparatus is illustrated, the parts corresponding to the elements in FIG. 9 being given the same reference numerals.

The apparatus further includes a base plate 42 with a set of upstanding tubular guides 43 on which sliding mounts for the support 39 and the induction furnace unit 41 are slidably mounted but adapted to be clamped at any selected position. The container 38 is urged upwardly against the refractory block 40 which is supported by a top cap 44 adapted to be bolted to a top plate 45. FIG. 10 shows the parts in slightly exploded view for clarity. The induction heating coil 41 is shown embedded within a refractory block 46 having a tapered bore, the drawing showing a greatly exaggerated taper and clearance between the bore and the container 38. The object of the tapered bore of the refractory block 46 is that any small expansion of the container 38 causes the container to be supported against further outward deformation by the refractory block but by virtue of the taper, the refractory block can be released by downward motion to the next location for the succeeding bellows container.

Figure 11:
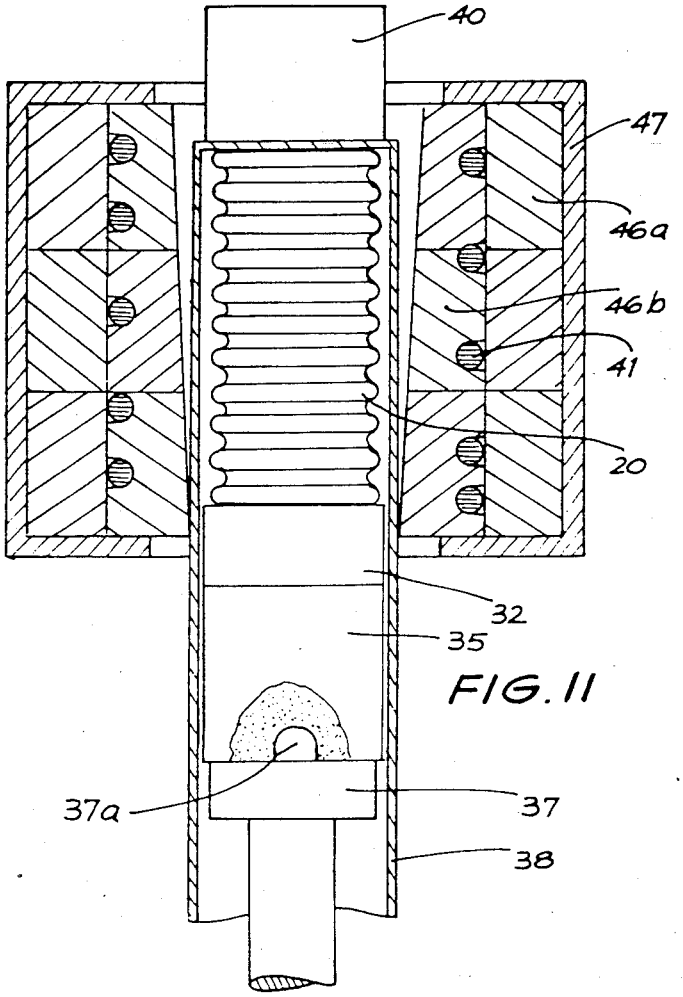
FIG. 11 is an axial sectional elevation on an enlarged scale of a preferred form of refractory block configuration shown generally in slightly exploded view in FIG. 10.

In the enlarged view of FIG. 11, like parts are given like reference numerals, and the parts are shown in the assembled condition just prior to pressing.

In this embodiment the refractory block is assembled from refractory segments comprising outer refractory segments **46*a* of cylindrical profile and inner refractory elements 46*b* having an inner profile adapted to cooperate to form a tapered bore with circumferentially extending grooves for accommodating the turns of the induction coil 41. The refractory elements are contained within a steel outer support cylinder 47 which absorbs the forces of any outward expansion applied by the container 38**.

Figure 12:
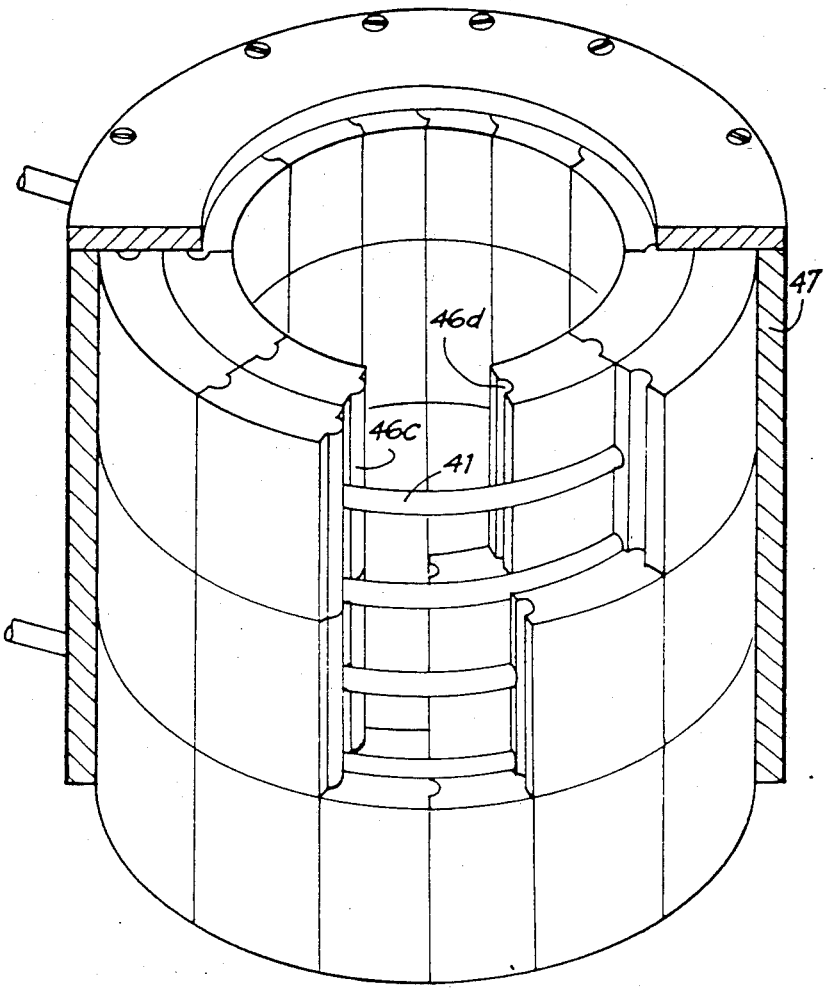
FIG. 12 is an isometric view from above of the refractory block and induction heating collar arrangement shown in FIG. 11.

FIG. 12 shows in isometric view the refractory blocks **46*a* and 46*b* each having a semi-circular rib 46*c* on one side thereof and a corresponding cavity 46*d*** on the other side for interengagement purposes.

We claim:

1. An improvement in the method for forming solid block which includes synthetic rock in which radioactive waste is immobilized, the improvement comprising:

(a) preparing a supply material comprising a minor proportion of radioactive waste and a material for forming the synthetic rock in sufficient quantity to immobilize said radioactive waste when the supply material is densified into a block;

(b) selecting a heat resistant steel container which is heat and corrosion resistant to contain the supply material during the method, the container having a side wall extending around an axis of the container and including a bellows-like structure for preventing gross outward deformation during the method;

(c) establishing a quantity of supply material in the container and arranging the container with the bellows-like structure free of surrounding (d) applying and maintaining for an extended time pressure along the axial direction of the container to compress the supply material while applying heat to maintain an elevated temperature to cause densification and the formation of a block of synthetic rock including the radioactive waste; and (e) either before or after said densification step, sealing the container with a cap whereby the sealed container is adapted to be placed in a suitable long term storage location.

2. A method as claimed in claim 1 wherein said bellows-like wall structure provided in the container comprises a series of convolutions extending from one axial end of the container to the other.

3. A method as claimed in claim 1, wherein the container and the cap are of metal and heat is applied by induction heating.

4. A method as claimed in claim 1, wherein the container has overall a substantially cylindrical configuration.

5. A method as claimed in claim 1 and including locating a tubular screen within the container which is of metal, leaving a space between the screen and the interior wall of the container, and pouring thermally insulating powder into said space before said supply material is poured into a zone within said tubular screen to fill the container.

6. A method as claimed in claim 1, wherein said container which is of metal is located within an outer cylinder and when the container is filled with supply material and closed with a cap, said pressure and heat is applied, the dimensions of said outer cylinder and container providing the container with a fit looser than an interference fit when compressed within the outer cylinder.

7. A method as claimed in claim 1, and comprising placing metal in contact with the supply material prior to the application of heat and pressure, said metal providing an oxygen potential for aiding incorporation of the nuclear reactor waste into the synthetic rock.

8. A method as claimed in claim 1, and comprising, as a preliminary step, forming the supply material into granules.

9. A method as claimed in claim 1 and including loading the supply material into thin-walled metal cans which will remain solid at the densification temperature but which deform upon densification of the supply material as it forms synthetic rock, the metal cans being loaded in sequence into the container.

10. A method as claimed in claim 1, wherein the container is of metal and of elongated cylindrical shape and said densification is effected in a series of zones in sequence extending from one end of the container by utilising electrical induction heating coils.

11. A method as claimed in claim 10 wherein the said heating zones overlap one another.

12. A method as claimed in claim 1, wherein the densification is effected at a temperature in the region of 1260° C. and at a pressure in the region of 7 MPA and for a time in the region of 3 hours.

13. A method according to claim 1 wherein said elevated temperature is at least in the region of 1100° to 1200° C.

14. A method according to claim 13 wherein the axial pressure is at least about 3000 lbs/sq. inch.

15. An improved method according to claim 1 in which the supply material is in a particulate form and the densification step produces about a 75% reduction in volume.

16. A method of containing and densifying particulate supply material comprising radioactive waste and synthetic rock precursor material, the method comprising pouring the supply material into a heat resistant steel bellows container of generally cylindrical from with a side wall including a bellows-like formation and of heat and decay resistant material, closing the bellows container with a lid, placing the bellows container on an upwardly displaceable ram having a heat resistant surface portion, displacing the ram upwardly to press the bellows container against a fixed abutment with the bellows-like formation free of surrounding support, maintaining substantially axially pressure through the ram on the bellows container, applying heat and maintaining a sufficiently elevated temperature in the bellows container for a sufficient length of time to cause densification of said particulate supply material in the bellows container and axial compression of the bellows container, the arrangement being such that deformation of the bellows container occurs in its axial direction, and removing the bellows container after completion of the densification step.

17. A method as claimed in claim 16, and wherein after closing the bellows container with a lid, a preliminary pre-heating thereof is effected substantially without the application of axial pressure to the bellows container.

18. A method as claimed in claim 17, wherein the bellows container is of metal and said pre-heating is by induction heating for a period of several hours to bring the bellows container and its contents substantially to a uniform temperature which is substantially elevated but sufficiently below the temperature to be achieved in the subsequent hot pressing step, said uniform temperature being selected such that the bellows container has significantly greater strength at the pre-heating temperature compared with the hot pressing temperature.

19. A method as claimed in claim 16, wherein said hot pressing step is conducted with the temperature of the bellows container and its contents brought to above 1200° C.

20. A method as claimed in claim 16, and wherein immediately after placing the lid on the bellows container an axial compression supplied to the bellows container, the temperature not exceeding 800° C.

21. A method as claimed in claim 20, and wherein the axial compression applied in the pressing step of claim 24 is at least 3000 lbs/sq. inch.

22. A method as claimed in claim 16, and wherein the supply material has a particle size not greater than 2 mm and is readily pourable, the supply material being produced by spraying a slurry into a rotary kiln.

23. A method as claimed in claim 16, and comprising using a refractory block incorporating inducton heating coils extending therethrough.

24. A method as claimed in claim 16, and including using a cylindrical partition within the bellows container and confining said supply material to the zone within said cylindrical partition, an alternative particulate material being located between said partition and the interior wall of the bellows container whereby the supply material is excluded from the convolutions of the wall of the bellows container.

25. A method according to claim 16 wherein said elevated temperature is at least in the region of 1100° to 1200° C.

26. A method according to claim 25 wherein the axial pressure is at least about 3000 lbs. sq. inch.

* * * * *